US008756845B2

(12) United States Patent
Harris et al.

(10) Patent No.: US 8,756,845 B2
(45) Date of Patent: Jun. 24, 2014

(54) METHOD AND DEVICE FOR CONVERTING FIREARM WITH DETACHABLE MAGAZINE TO A FIREARM WITH FIXED MAGAZINE

(71) Applicant: Courtney Harris, San Diego, CA (US)

(72) Inventors: Courtney Harris, San Diego, CA (US); Sean Thomas, Allen, TX (US); Robert Bernard, McKinney, TX (US)

( * ) Notice: Subject to any disclaimer, the term of this patent is extended or adjusted under 35 U.S.C. 154(b) by 0 days.

(21) Appl. No.: 13/803,966

(22) Filed: Mar. 14, 2013

(65) Prior Publication Data

US 2013/0269232 A1 Oct. 17, 2013

(51) Int. Cl.
*F41A 9/61* (2006.01)

(52) U.S. Cl.
USPC ..... 42/49.01; 42/6; 42/50; 42/16; 42/18

(58) Field of Classification Search
USPC ..... 42/49.01, 16, 18, 6, 50, 70.02
See application file for complete search history.

(56) References Cited

U.S. PATENT DOCUMENTS

| | | | | |
|---|---|---|---|---|
| 4,429,479 | A * | 2/1984 | Johnson | 42/6 |
| 4,615,134 | A * | 10/1986 | Beretta | 42/6 |
| 5,517,897 | A * | 5/1996 | Perrine | 89/189 |
| 5,519,954 | A * | 5/1996 | Garrett | 42/6 |
| 6,070,352 | A * | 6/2000 | Daigle | 42/49.02 |
| 7,219,462 | B2 * | 5/2007 | Finn | 42/49.01 |
| 7,661,219 | B1 * | 2/2010 | Knight et al. | 42/70.02 |
| 7,921,587 | B2 * | 4/2011 | Mayberry | 42/6 |
| 8,327,749 | B2 * | 12/2012 | Underwood | 89/138 |
| 8,418,390 | B1 * | 4/2013 | Wright | 42/49.01 |
| 2005/0183310 | A1 * | 8/2005 | Finn | 42/49.01 |
| 2006/0123683 | A1 * | 6/2006 | Garrett et al. | 42/6 |
| 2010/0281736 | A1 * | 11/2010 | Mayberry et al. | 42/49.01 |
| 2010/0307042 | A1 * | 12/2010 | Jarboe et al. | 42/6 |
| 2011/0056107 | A1 * | 3/2011 | Underwood | 42/18 |
| 2011/0271827 | A1 * | 11/2011 | Larson et al. | 89/193 |
| 2011/0277365 | A1 * | 11/2011 | Barletta | 42/6 |
| 2012/0159828 | A1 * | 6/2012 | Jarboe et al. | 42/16 |
| 2012/0174451 | A1 * | 7/2012 | Overstreet et al. | 42/16 |
| 2012/0180354 | A1 * | 7/2012 | Sullivan et al. | 42/16 |
| 2012/0198742 | A1 * | 8/2012 | Troy et al. | 42/6 |
| 2012/0297656 | A1 * | 11/2012 | Langevin et al. | 42/16 |
| 2013/0014418 | A1 * | 1/2013 | Dextraze et al. | 42/16 |
| 2013/0152442 | A1 * | 6/2013 | Underwood | 42/6 |
| 2013/0227869 | A1 * | 9/2013 | Thordsen | 42/6 |
| 2013/0269231 | A1 * | 10/2013 | Pietrzyk | 42/6 |
| 2013/0326924 | A1 * | 12/2013 | Jarboe et al. | 42/17 |
| 2014/0013640 | A1 * | 1/2014 | Munson | 42/6 |
| 2014/0053444 | A1 * | 2/2014 | Garrett | 42/6 |
| 2014/0075814 | A1 * | 3/2014 | Larson et al. | 42/72 |

* cited by examiner

*Primary Examiner* — Michelle Clement
(74) *Attorney, Agent, or Firm* — Kevin Keener; Keener and Associates P.C.

(57) ABSTRACT

An accessory which becomes an integral part of a semi-automatic firearm whereby the firearm is converted from one with a detachable magazine into one with a fixed magazine. The device is comprised of an upper tension bar and a magazine catch bar whereby the upper tension bar holds the magazine firmly within the magazine well receiver when the upper tension bar is contacting the upper receiver. When the upper receiver and lower receiver of the firearm are in an open position, the upper tension bar freely moves inward toward the firearm, allowing the magazine catch bar to remove from the magazine well receiver. A user may then remove the magazine from the magazine well receiver and replace it with a new magazine. The user must reattach the upper receiver to the lower receiver before utilizing the firearm.

20 Claims, 5 Drawing Sheets

METHOD AND DEVICE FOR CONVERTING FIREARM WITH DETACHABLE MAGAZINE TO A FIREARM WITH FIXED MAGAZINE

TECHNICAL FIELD

The invention relates generally to semi-automatic firearms and more specifically to a device and method for converting a semi-automatic firearm with a -detachable magazine to a semi-automatic firearm with a fixed magazine.

BACKGROUND OF THE INVENTION

Semi-automatic firearms have been known for a long time. The first semi-automatic rifle was introduced in 1885. The M-16 automatic rifle has been used by the military for years. A civilian version of the M-16 is known as the AR-15 and is a semi-automatic rifle. The AR-15 has been manufactured and sold to civilians for many years. Standard AR-15 semi-automatic rifles are manufactured and distributed with detachable magazines. A detachable magazine allows a user to fire the gun multiple times until all bullets in the magazine have been fired. When the magazine is depleted, the user pushes a magazine release button. This releases the magazine from the rifle. The user may then insert a new magazine and resume firing. When used herein, the phrase "semi-automatic rifle" is intended to include the AR-15s previously and currently being manufactured.

Semi-automatic firearms, particularly those with detachable magazines, are coming under heightened regulation and restriction. A bill is currently pending before the U.S. Congress known as the "Assault Weapons Ban of 2013." The bill states that "It shall be unlawful for a person to import, sell, manufacture, transfer, or possess, in or affecting interstate or foreign commerce, a semiautomatic assault weapon." The bill defines a "semiautomatic assault weapon as:

"(A) A semiautomatic rifle that has the capacity to accept a detachable magazine and any 1 of the following: (i) A pistol grip. (ii) A forward grip. (iii) A folding, telescoping, or detachable stock. (iv) A grenade launcher or rocket launcher. (v) A barrel shroud. (vi) A threaded barrel.

(B) A semiautomatic rifle that has a fixed magazine with the capacity to accept more than 10 rounds, except for an attached tubular device designed to accept, and capable of operating only with, .22 caliber rimfire ammunition. Sec. 2(a)(1)."

The bill further defines a "detachable magazine" as "an ammunition feeding device that can be removed from a firearm without disassembly of the firearm action." The bill also defines a "fixed magazine" as "an ammunition feeding device that is permanently fixed to the firearm in such a manner that it cannot be removed without disassembly of the firearm."

As such, the planned legislation would ban all semi-automatic rifles that can accept a detachable magazine, all semi-automatic rifles that have a fixed magazine that accept more than ten rounds, and any part, combination of parts, component, device, attachment, or accessory that is designed or functions to accelerate the rate of fire of a semiautomatic rifle.

The standard semi-automatic rifle is manufactured and sold with a detachable magazine. Users can replace a magazine in the standard semi-automatic rifles without disassembling the firearm action. Such semi-automatic rifles are likely to face increased restriction and regulation. What is needed is a device and method for easily converting a semi-automatic rifle with a detachable magazine to a semi-automatic rifle with a fixed magazine.

SUMMARY OF THE INVENTION

The present invention is a device and method for converting a semi-automatic rifle with a detachable magazine into a semi-automatic rifle with a fixed magazine. The device more specifically relates to a device which becomes an integral part of a semi-automatic rifle whereby a magazine catch is positioned such that a magazine can only be released when the upper receiver is removed from the lower receiver.

It is an object of the invention to provide a device whereby a semi-automatic firearm with a detachable magazine can be converted to a semi-automatic firearm with a fixed magazine.

It is another object of the invention to provide an accessory which provides a connection between a firearm and its magazine whereby the magazine can only be removed when the firearm action is in a disassembled state. With the invention installed on a firearm, the firearm will no longer accept a detachable magazine. The firearm can only accept a fixed magazine when the firearm action is disassembled.

It is a purpose of the invention to slow the rate of fire of semi-automatic firearms. The invention is a permanent fixture added to a semi-automatic firearm that cannot be readily removed from the firearm. When installed on a semi-automatic firearm, the firearm will no longer accept detachable magazines. When installed on a semi-automatic firearm, a magazine may only be withdrawn and replaced when the upper receiver is removed from the lower receiver and the firearm action is disassembled. In addition, the invention is intended to be utilized only with semi-automatic firearms utilizing magazines of no more than ten rounds.

It is an object of the invention to provide improved elements and arrangements thereof in an apparatus for the purposes described which is inexpensive, dependable, and effective in accomplishing its intended purposes.

A standard OEM semi-automatic rifle contains a magazine catch assembly. A standard magazine catch assembly is comprised of a magazine catch, a spring, and magazine release button. The magazine catch consists of two ends which occur at a substantially right angle. One end is a threaded screw. The other end is a substantially flat member. When installed in a semi-automatic rifle, the spring is placed over the threaded screw end of the magazine catch. The screw is then inserted through the lower receiver and threaded through the magazine catch button on the opposite side of the lower receiver. The opposite end of the magazine catch rests within a recess in the magazine well receiver. When a magazine is placed in the magazine well the magazine catch slides into a recess in the magazine. The catch holds the magazine in place while the firearm is in use. To release the magazine, a user pushes the magazine release button. When the magazine release button is depressed the magazine catch is lifted from the recess in the magazine and the magazine freely slides out of the magazine well.

The invention is a device which is installed as a permanent component of the firearm. The invention is a permanent fixture added to a semi-automatic firearm by removing the standard OEM magazine catch assembly and installing the invention. To remove the magazine catch assembly a person can depress the magazine release button. The user can then rotate the free end of the magazine catch in a counterclockwise motion. This motion unthreads the magazine catch from the magazine release button. Once the magazine catch is completely unthreaded, all parts of the factory installed assembly can be removed from the lower receiver.

In accordance with one aspect of the present invention, a firearm is provided comprising a lower receiver, a magazine catch bar, and an upper tension bar. The magazine catch bar is securely attached to the lower receiver and fits within a recess in the magazine well of the lower receiver. The upper tension bar applies a pressure against the upper receiver of the firearm, sufficient to render the magazine catch bar immovable when the upper receiver and lower receiver of the firearm are firmly attached in a closed position. The magazine catch bar freely moves when the upper receiver and the lower receiver of the firearm are apart and in an open position, permitting the magazine catch bar to lift from the magazine side-locking recess sufficiently to permit a magazine to be removed from the magazine well of the lower receiver when the upper receiver and the lower receiver of the firearm are apart and in an open position. The upper tension bar may contain a set screw permitting a user to adjust the pressure at the point of contact between the upper tension bar and the upper receiver. The upper tension bar and magazine catch bar are attached to the lower receiver by means of a screw which passes through the lower receiver. The upper tension bar and magazine catch bar are positioned on separate sides of the lower receiver.

In accordance with another aspect of the present invention a firearm subassembly is provided comprising a magazine catch, a magazine catch pivot, a screw and a screw spacer. The magazine catch is comprised of two extended members, a magazine catch bar and an upper tension bar. The upper tension bar applies a pressure against the upper receiver of the firearm, sufficient to render the magazine catch bar immovable when the upper receiver and lower receiver of the firearm are firmly attached in a closed position. The magazine catch bar freely moves when the upper receiver and the lower receiver of the firearm are apart and in an open position, permitting the magazine catch bar to lift from the magazine side-locking recess sufficiently to permit a magazine to be removed from the magazine well of the lower receiver when the upper receiver and the lower receiver of the firearm are apart and in an open position. The upper tension bar may contain a set screw permitting a user to adjust the pressure at the point of contact between the upper tension bar and the upper receiver. The magazine catch pivot is securely attached to the lower receiver of the firearm by means of a screw extending through the lower receiver of the firearm. The magazine catch pivot fits inside a recess within the magazine catch and is securely attached to the magazine catch. The magazine catch pivot can be of any shape. The recess in the magazine catch can be of any shape to receive the shape of the magazine catch pivot. The subassembly also comprises a screw spacer fitting within the recess for the magazine release button of the lower receiver.

In accordance with another aspect of the invention, a method is provided for converting a firearm with a detachable magazine into a firearm with a fixed magazine comprising the steps of removing the factory installed magazine release assembly by depressing the magazine release by depressing the magazine release button to a sufficient depth to permit the factory installed magazine catch bar to extend beyond the magazine well of the lower receiver, rotating the factory installed magazine catch bar in a counterclockwise fashion until the factory installed magazine catch bar is unthreaded from the factory installed screw end of the magazine release button, and removing all parts of the factory installed magazine release button assembly, installing a magazine catch bar onto the lower receiver of the firearm where the magazine catch bar rests within the magazine side-locking recess, and installing an upper tension bar onto the lower receiver of the firearm where the upper tension bar extends towards and contacts the upper receiver. In this method the upper tension bar applies a pressure against the upper receiver of the firearm pressure sufficient to render the magazine catch bar immovable when the upper receiver and lower receiver of the firearm are firmly attached in a closed position. In this method the magazine catch bar freely moves when the upper receiver and the lower receiver of the firearm are apart and in an open position, permitting the magazine catch bar to lift from the magazine side-locking recess sufficient to permit a magazine to be removed from the magazine well of the lower receiver when the upper receiver and the lower receiver of the firearm are apart and in an open position. The method may be one where the magazine catch bar and upper tension bar are two separate extended members of one magazine catch. The method may further comprise attaching a magazine catch pivot securely to the lower receiver of the by means of a screw extending through the lower receiver of the firearm. The magazine catch pivot may be of any shape. The method may further comprise fitting the magazine catch pivot inside a recess within the magazine catch and securely attaching the magazine catch pivot to the magazine catch. The recess in the magazine catch may be of any shape to receive the magazine catch pivot. The method may further comprise fitting a screw spacer within the recess for the magazine release button on the lower receiver, the screw spacer containing a central hole allowing a screw to pass through, passing a screw through the screw spacer, and securely threading the screw into the magazine catch pivot.

DETAILED DESCRIPTION

Figure 1:
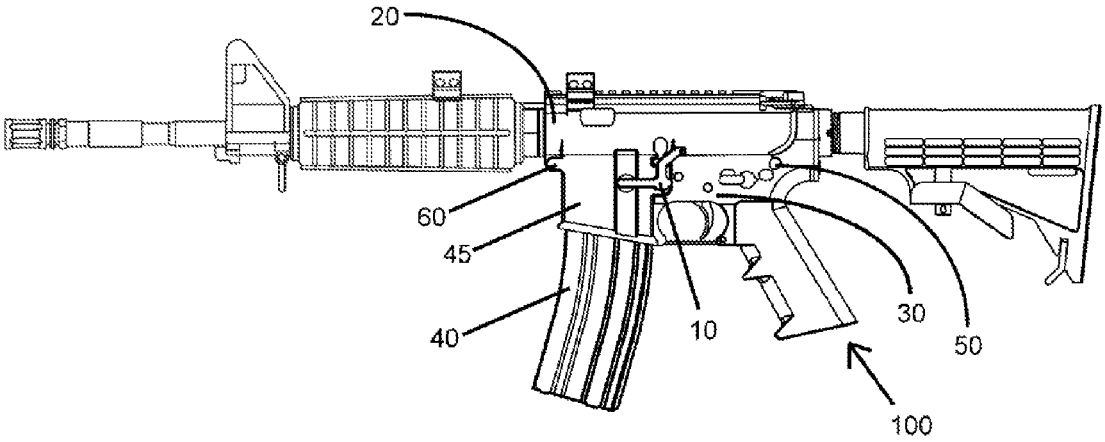
FIG. 1 is a side view of a firearm with an embodiment of the invention installed.

Since the basic firearm is of a well-known type, only those parts of the firearm essential to an understanding of the invention will be described in detail. Although the present invention will be described with reference to the exemplary embodiments shown in the drawings, it should be understood that the present invention can be embodied in many alternate forms or embodiments. In addition, any suitable size, shape or type of elements or materials could be used.

Figure 2:
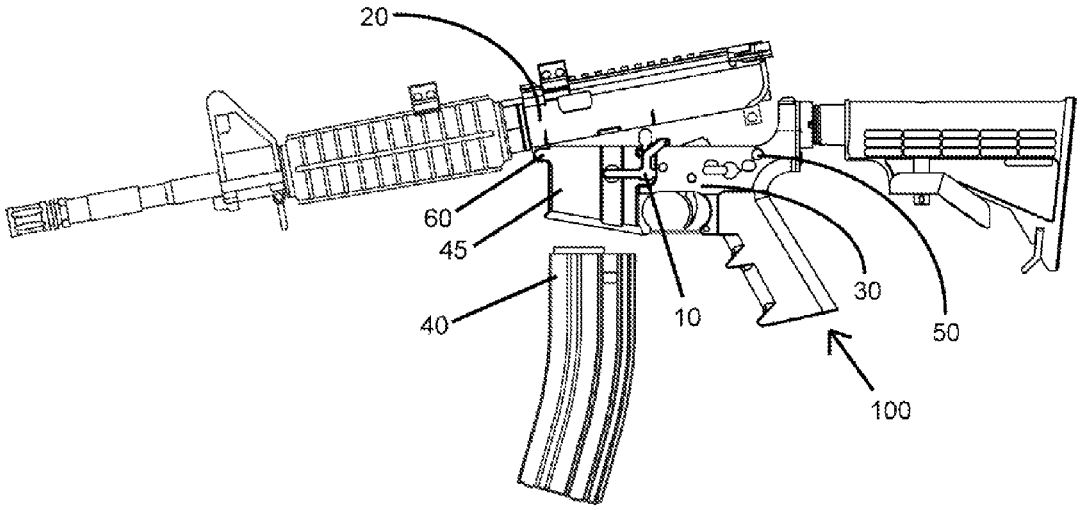
FIG. 2 is a side view a firearm with an embodiment of the invention installed where the upper receiver and lower receiver of the firearm are separated

Referring to FIGS. 1-2 the firearm 100 is comprised of an upper receiver 20 and a lower receiver 30. The lower receiver 30 comprises partially of a magazine well receiver 45 and a rear takedown pin 50. The magazine well receiver 45 is structured to accept a magazine 40 containing rounds of ammunition. As FIG. 2 shows, the lower receiver 30 and upper receiver 20 can scissored open when the rear takedown pin 50 is removed, allowing the upper receiver 20 to be pivoted at the point of the pivot pin 60. FIGS. 1-2 show the invention 10 attached to the lower receiver 30.

As shown in FIG. 1, when the lower receiver 30 is attached to the upper receiver 20, the invention 10 is securely placed in a recess in the magazine well 45 to hold the magazine 40 in place so that it cannot be removed from the magazine well 45.

As shown in FIG. 2, when the lower receiver 30 is separated from the upper receiver 20, the invention 10 freely moves out of the recess in the magazine well 45, allowing the magazine 40 to be removed from the magazine well 45.

Figure 3:
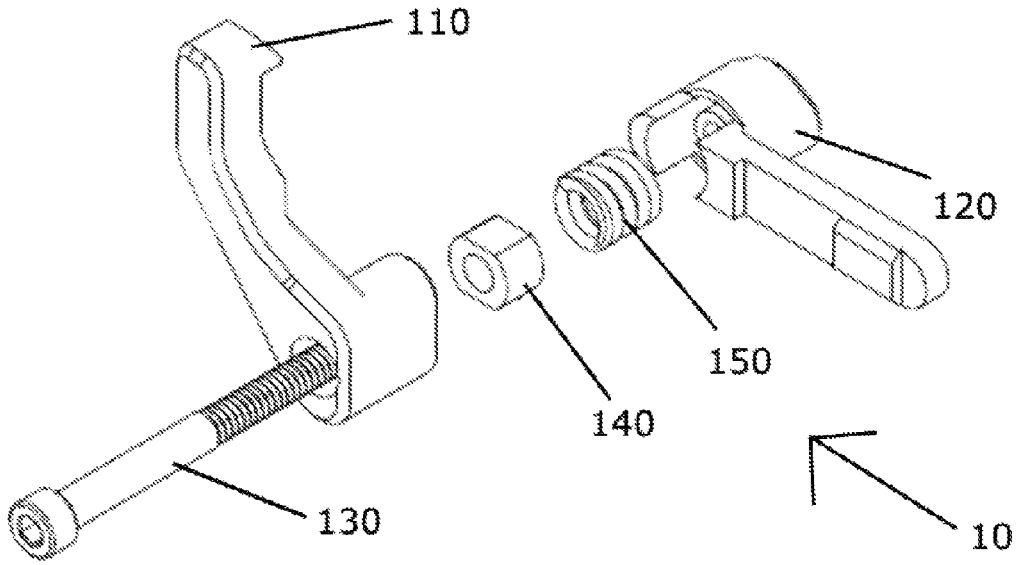
FIG. 3 is an exploded view of an embodiment of the invention where the upper tension bar is separate from the magazine catch bar

FIG. 3 displays one embodiment of the invention. The device 10 is comprised of an upper tension bar 110, a magazine catch bar 120, a screw 130, an internal screw spacer 140, and a magazine catch bar spring 150. In this embodiment the upper tension bar 110 is separate from the magazine catch bar 120. The upper tension bar 110 is placed on the opposite side of the lower receiver 30 than the magazine catch bar 120. In this embodiment the upper tension bar 110 is placed in the position where the original magazine release button was installed on the lower receiver 30. The top end of the upper tension bar 110 extends towards and contacts the upper receiver 20. The screw 130 passes through the lower end of the upper tension bar 110 and into the lower receiver 30. The screw 130 passes through the center of the internal screw spacer 140 and the magazine catch bar spring 150 until it is firmly threaded into the magazine catch bar 120. In this embodiment, the magazine catch bar spring 150 pushes the magazine catch bar 120 outward and away from the lower receiver 30. The furthest end of the magazine catch bar 120 passes through a recess in the magazine well receiver 45 and against the magazine 40.

In this embodiment the device 10 operates by the force applied by the magazine catch bar spring 150. The magazine catch bar spring 150 pushes the magazine catch bar 120 outward and away from the firearm 100. This outward movement is transferred through the screw 130 to the upper tension bar 110. The outward movement of the magazine catch bar 120 causes the upper tension bar 110 to move inward toward the firearm 100. When the upper receiver 20 and the lower receiver 30 are placed together, the upper tension bar 110 applies pressure against the upper receiver 20, due to the force exerted by the magazine catch bar spring 150. The upper receiver 20 prevents any inward movement by the upper tension bar 110. Because the upper tension bar 110 cannot move inward toward the firearm 100, the magazine catch bar 120 remains resting within the recess in the magazine well receiver 45. The magazine catch bar 120 thus remains in full contact with the magazine 40 and prevents the magazine 40 from being removed from the magazine well receiver 45. This device 10 prevents the magazine 40 from being removed from the firearm 100 when the upper receiver 20 and lower receiver 30 are closed and pinned together. Thus, the device 10 changes the firearm 100 into one with a fixed magazine.

In this embodiment, the upper tension bar 110 applies an inward pressure against the upper receiver 20 because of the force applied by the magazine catch bar spring 150. In this embodiment of the invention, to remove the magazine 40 a user must remove the rear takedown pin 50. The removal of the rear takedown pin 50 allows the upper receiver 20 to pivot away from the lower receiver 30 at the pivot pin point 60. This action is called "scissoring." When the lower receiver 30 and upper receiver 20 are scissored open, the upper tension bar 110 is no longer in contact with the upper receiver 20. When the upper receiver 20 is removed from the lower receiver 30 the upper tension bar 110 is no longer in contacting the upper receiver 20. The tip of the upper tension bar 110 may then freely move inward. The force applied by the magazine catch bar spring 150 pushes the magazine catch bar 120 outward and away from the lower receiver 30. Because there is no resistance between the upper tension bar 110 and upper receiver 20, the upper tension bar 110 moves inward toward the firearm 100. The inward movement of the upper tension bar 110 allows the magazine catch bar spring 150 to push the magazine catch bar 120 outward and away from the firearm 100. The outward movement of the magazine catch bar 120 removes the contact between the magazine catch bar 120 and the magazine 40. With the resistance between the magazine catch bar 120 and the magazine 40 removed, the magazine 40 is free to slide out of the magazine well receiver 45. A user may then insert a new magazine 40 into the magazine well receiver 45. The user then reattaches the upper receiver 20 to the lower receiver 30 and inserts the rear takedown pin 50. The device 10 is once more in its original position where the upper tension bar 110 contacts the upper receiver 20 and the magazine catch bar 120 passes through the recess in the magazine well receiver 45 and contacts the magazine 40. Once closed, the magazine 40 is now a fixed magazine and may not be removed from the firearm 100 while the upper receiver 20 is attached to the lower receiver 30. Once closed, the firearm 100 may be utilized to be fired.

Figure 4:
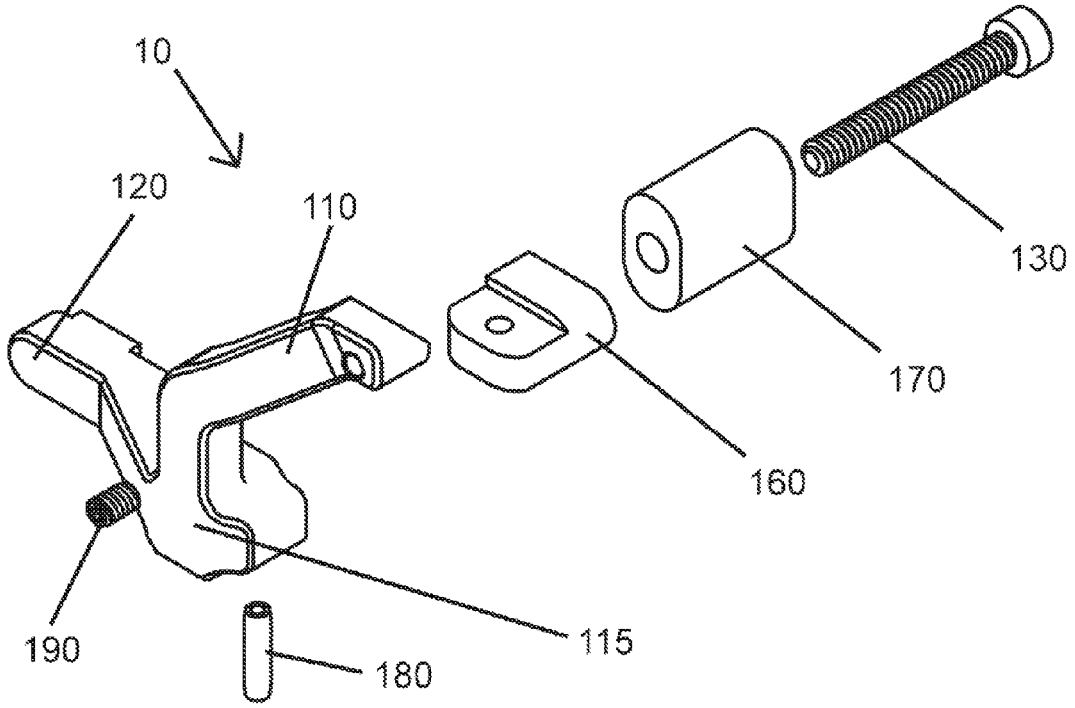
FIG. 4 is an exploded view of the preferred embodiment of the invention where the upper tension bar and magazine catch bar are connected together as one item
Figure 5:
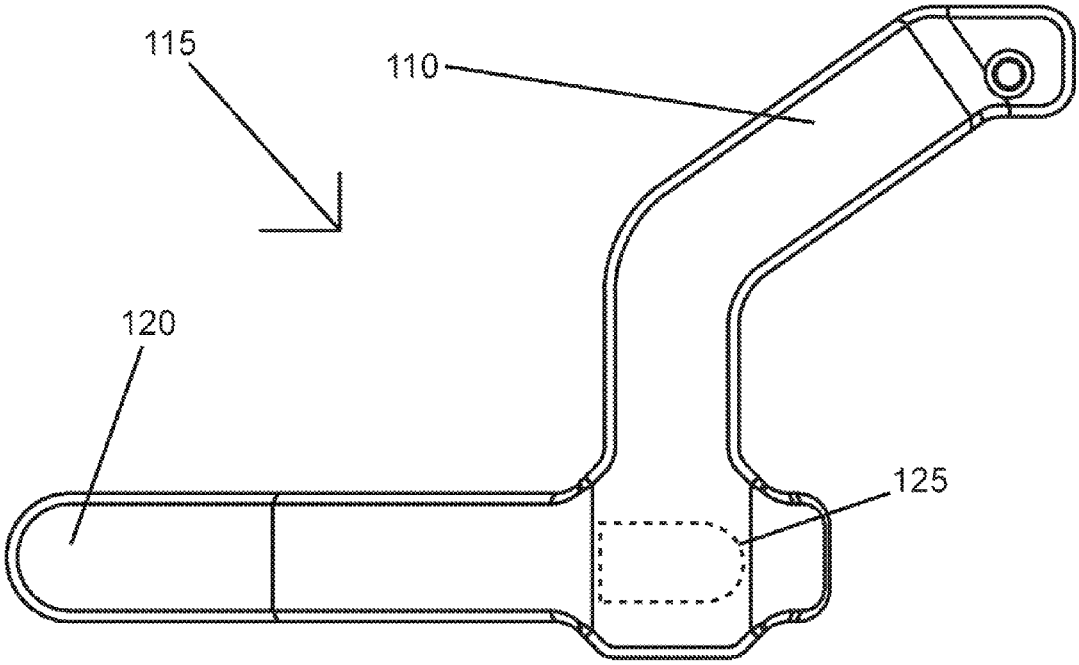
FIG. 5 is a side view of the preferred embodiment of the invention

FIGS. 4-5 display one embodiment of the invention. The device 10 is comprised of a magazine catch 115, a magazine catch pivot 160, a screw 130, a screw spacer 170, a spring pin 180, and a set screw 190. The magazine catch 115 is comprised of two separate ends. The first end is the magazine catch bar 120 and the second end is the upper tension bar 110. The magazine catch bar 120 end rests in the recess of the magazine well receiver 45. The upper tension bar 110 end protrudes at an angle from the magazine catch bar 120 end such that when the magazine catch bar 120 end rests in the recess of the magazine well receiver 45 the upper tension bar 110 extends up to and comes in contact with the upper receiver 20 of the firearm. The set screw 190 threads through a threaded hole in the upper tension bar 110. The set screw 190 provides can be threaded outward from the upper tension bar 110 until it contacts the upper receiver 20. The set screw 190 can be adjusted so that sufficient pressure is exerted against the upper receiver 20 to maintain the magazine catch bar 120 well seated in the recess in the magazine well receiver 45 and hold the magazine 40 locked in place. At the elbow bend where the magazine catch bar 120 end and the upper tension bar 110 end meet there is a lateral recess 125 in the magazine catch 115. The lateral recess 125 allows for the magazine catch pivot 160 to be inserted into the magazine catch 115. The magazine catch pivot 160 can be of any shape. The lateral recess 125 can be of any shape to receive the magazine catch pivot 160. The magazine catch pivot 160 can be secured to the magazine catch by a number of means, such as a screw, or, as shown in FIG. 4, a spring pin 180.

The magazine catch pivot 160 has two ends. One end of the magazine catch pivot 160 is shaped to fit within the lateral recess 125 of the magazine catch 115. The opposite end of the magazine catch pivot 160 contains a threaded receptor for the screw 130. The screw 130 is placed through a screw spacer 170 and then extended through the lower receiver 30 such that the screw spacer 170 is located on the side of the lower receiver 30 where the factory installed magazine release button was located. The free end of the screw 130 is threaded through the magazine catch pivot 160 on the opposite side of the lower receiver 30.

The device 10 operates such that when the upper receiver 20 and the lower receiver 30 are placed together, the upper tension bar 110 applies pressure against the upper receiver 20, flexing the upper tension bar 110 outward. This outward pressure on the upper tension bar 110 causes the magazine catch 115 to pivot at the junction between the magazine catch 115 and the magazine catch pivot 160. This pivoting motion is transferred to the magazine catch bar 120 such that the magazine catch bar 120 applies an inward pressure through the recess in the magazine well receiver 45 and applies an inward pressure against the recess in the magazine 40. This inward pressure prevents the magazine 40 from being removed from the firearm 100 when the upper receiver 20 and lower receiver 30 are closed and pinned together. Thus, the device 10 changes the firearm 100 into one with a fixed magazine.

In this embodiment of the invention, to remove the magazine 40 a user must remove the rear takedown pin 50. The removal of the rear takedown pin 50 allows the upper receiver 20 to pivot away from the lower receiver 30 at the pivot pin point 60. When the lower receiver 30 and upper receiver 20 are scissored open, the upper tension bar 110 is no longer in contact with the upper receiver 20. Without resistance of movement from the upper receiver 20, the upper tension bar 110 may not pivot inward toward the firearm 100. This pivoting inward of the upper tension bar 110 allows the magazine catch bar 120 to pivot outward from the firearm 100. The outward movement of the magazine catch bar 120 removes the contact between the magazine catch bar 120 and the magazine 40. With the resistance between the magazine catch bar 120 and the magazine 40 removed, the magazine 40 is free to slide out of the magazine well receiver 45. A user may then insert a new magazine 40 into the magazine well receiver 45. The user then reattaches the upper receiver 20 to the lower receiver 30 and inserts the rear takedown pin 50. Once closed, the firearm 100 may be utilized to be fired.

The invention claimed is:

1. A firearm with a fixed magazine comprising a lower receiver having a magazine well configured to receive a magazine with a side-locking recess with a recess in the magazine well a magazine catch bar securely attached to the firearm, said magazine catch bar resting within the magazine side-locking recess an upper tension bar which extends towards and contacts the upper receiver.

2. The firearm as in claim 1 wherein said upper tension bar applies a pressure against the upper receiver of the firearm, said pressure sufficient to render the magazine catch bar immovable when the upper receiver and lower receiver of the firearm are firmly attached in a closed position.

3. The firearm as in claim 2 wherein said magazine catch bar freely moves when the upper receiver and the lower receiver of the firearm are apart and in an open position, permitting the magazine catch bar to lift from the magazine side-locking recess wherein said magazine catch bar lifts from the side-locking recess sufficiently to permit a magazine to be removed from the magazine well of the lower receiver when the upper receiver and the lower receiver of the firearm are apart and in an open position.

4. The firearm as in claim 3 further comprising a set screw set into the end of the upper tension bar, said set screw contacting the upper receiver, said set screw able to be adjusted such that the pressure at the point of contact between said set screw and said upper receiver may be increased or decreased.

5. The firearm as in claim 4 wherein the magazine catch bar and upper tension bar are two separate extended members of one magazine catch.

6. The firearm as in claim 5 further comprising a magazine catch pivot, said magazine catch pivot securely attached to the lower receiver of the firearm by means of a screw extending through the lower receiver of the firearm wherein said magazine catch pivot fits inside a recess within the magazine catch and is securely attached to said magazine catch.

7. The firearm as in claim 6 further comprising a screw spacer said screw spacer fitting within the recess for the magazine release button of the lower receiver, said screw spacer containing a central hole allowing said screw to pass through said screw spacer.

8. A device for converting a firearm with a detachable magazine into a firearm with a fixed magazine comprising A magazine catch bar securely attached to the lower receiver of said firearm, said magazine catch bar resting within the magazine side-locking recess An upper tension bar which extends towards and contacts the upper receiver

9. The device as in claim 8 wherein said upper tension bar applies a pressure against the upper receiver of the firearm, said pressure sufficient to render the magazine catch bar immovable when the upper receiver and lower receiver of the firearm are firmly attached in a closed position.

10. The device as in claim 9 wherein said magazine catch bar freely moves when the upper receiver and the lower receiver of the firearm are apart and in an open position, permitting the magazine catch bar to lift from the magazine side-locking recess wherein said magazine catch bar lifts from the side-locking recess sufficiently to permit a magazine to be removed from the magazine well of the lower receiver when the upper receiver and the lower receiver of the firearm are apart and in an open position.

11. The device as in claim 10 further comprising a set screw set into the end of the upper tension bar said set screw contacting the upper receiver said set screw able to be adjusted such that the pressure at the point of contact between said set screw and said upper receiver may be increased or decreased.

12. The device as in claim 11 wherein the magazine catch bar and upper tension bar are two separate extended members of one magazine catch.

13. The device as in claim 12 further comprising a magazine catch pivot, said magazine catch pivot securely attached to the lower receiver of the firearm attached by means of a screw extending through the lower receiver of the firearm wherein said magazine catch pivot fits inside a recess within the magazine catch and is securely attached to said magazine catch.

14. The device as in claim 12 further comprising a screw spacer, said screw spacer fitting within the recess for the magazine release button of the lower receiver, said screw spacer containing a central hole allowing said screw to pass through said screw spacer.

15. A method for converting a firearm with a detachable magazine into a firearm with a fixed magazine comprising Removing the factory installed magazine release button assembly Said removal comprising the steps of depressing the magazine release button to a sufficient depth to permit the factory installed magazine catch bar to extend beyond the magazine well of the lower receiver, rotating the factory installed magazine catch bar in a counterclockwise fashion until the factory installed magazine catch bar is unthreaded from the factory installed screw end of the magazine release button, removing all parts of the factory installed magazine release button assembly Installing a magazine catch bar to the lower receiver of the firearm, said magazine catch bar resting within the magazine side-locking recess Installing an upper tension bar to the lower receiver of the firearm, said upper tension bar extending towards and contacting the upper receiver.

16. The method as in claim 15 wherein said upper tension bar applies a pressure against the upper receiver of the firearm, said pressure sufficient to render the magazine catch bar immovable when the upper receiver and lower receiver of the firearm are firmly attached in a closed position.

17. The method as in claim 16 wherein said magazine catch bar freely moves when the upper receiver and the lower receiver of the firearm are apart and in an open position, permitting the magazine catch bar to lift from the magazine side-locking recess wherein said magazine catch bar lifts from the side-locking recess sufficiently to permit a magazine to be removed from the magazine well of the lower receiver when the upper receiver and the lower receiver of the firearm are apart and in an open position.

18. The method as in claim 17 wherein the magazine catch bar and upper tension bar are two separate extended members of one magazine catch.

19. The method as in claim 18 further comprising the step of attaching a magazine catch pivot securely to the lower receiver of the firearm wherein said magazine catch pivot is attached by means of a screw extending through the lower receiver of the firearm.

20. The method as in claim 19 further comprising the steps of securely attaching the magazine catch pivot to the magazine catch wherein said magazine catch pivot fits inside a recess within the magazine catch fitting a screw spacer within the recess for the magazine release button on the lower receiver said screw spacer containing a central hole allowing a screw to pass through passing a screw through the screw spacer securely threading said screw into the magazine catch pivot.

* * * * *